US006873673B2

(12) United States Patent
Georgii

(10) Patent No.: US 6,873,673 B2
(45) Date of Patent: Mar. 29, 2005

(54) DEVICE FOR STORING HEAT GENERATING MATERIAL AND A VESSEL FOR SUCH DEVICE

(75) Inventor: Hans Georgii, London (GB)

(73) Assignee: Oyster International N.V., Curacau (NL)

( * ) Notice: Subject to any disclaimer, the term of this patent is extended or adjusted under 35 U.S.C. 154(b) by 0 days.

(21) Appl. No.: 10/470,341

(22) PCT Filed: Jan. 29, 2002

(86) PCT No.: PCT/SE02/00151

§ 371 (c)(1),
(2), (4) Date: Jul. 28, 2003

(87) PCT Pub. No.: WO02/061762

PCT Pub. Date: Aug. 8, 2002

(65) Prior Publication Data

US 2005/0014988 A1 Jan. 20, 2005

(30) Foreign Application Priority Data

Jan. 29, 2001 (SE) ..... 0100247

(51) Int. Cl.[7] ..... G21F 5/00
(52) U.S. Cl. ..... 376/272; 250/506.1; 588/3
(58) Field of Search ..... 376/272, 406; 250/506.1, 507.1; 588/3, 16

(56) References Cited

U.S. PATENT DOCUMENTS 3,401,082 A * 9/1968 Ammon ..... 376/406
3,845,315 A * 10/1974 Blum ..... 250/506
4,634,875 A * 1/1987 Kugeler et al. ..... 250/506.1
4,649,018 A * 3/1987 Waltersdorf et al. ..... 376/272
4,708,522 A * 11/1987 Bergman et al. ..... 405/55
6,696,695 B1 * 2/2004 Georgii ..... 376/272

FOREIGN PATENT DOCUMENTS

| | | |
|---|---|---|
| GB | 125009 | 10/1971 |
| WO | WO 96/21932 | 7/1996 |
| WO | WO 01/78082 | 10/2001 |

* cited by examiner

*Primary Examiner*—Harvey E. Behrend
(74) *Attorney, Agent, or Firm*—Stites & Harbison PLLC; Douglas E. Jackson

(57) ABSTRACT

A device for storing heat-generating hazardous material, particularly radio-active fuel for nuclear reactors, comprises a substantially cylindrical, reinforced concrete body (11) with a cylindrical through center passage (13) and a plurality of axially elongate, substantially cylindrical storage spaces for accommodating the hazardous material which are disposed around and parallel to and radially spaced spaced from the center passage. The storage spaces are formed by sealed storage vessels (21) containing a fluid coolant and made of a heat-conducting material and being encapsulated in the concrete body (11). Heat transferred inwardly from the storage vessels (21) is carried away from the device by air or other fluid coolant flowing upwardly in the center passage (13). A storage vessel (21) for the storage device has an inner compartment (27) for accommodating the hazardous material and an outer compartment (25) surrounding the inner compartment (27) and forming therewith a closed circulation path for the fluid coolant.

12 Claims, 5 Drawing Sheets

DEVICE FOR STORING HEAT GENERATING MATERIAL AND A VESSEL FOR SUCH DEVICE

This invention relates to a device for storing nuclear fuel and a vessel for inclusion in such device.

When spent nuclear fuel is taken out of a reactor in a nuclear power plant; it is commonly placed in a pool in the vicinity of the reactor, in most cases within the nuclear power plant, pending transport to a reprocessing site or to a repository for long-term storage, such as a site for final disposal. During one or more stages of its management, the nuclear fuel is stored in a container of one kind or another. This container may be of different kinds, depending on whether the storage is temporary, such as when the container is used to accommodate the nuclear fuel only while waiting for shipping or during transport from one place to another, or of a long-term character.

In this context it is known to use an inner container formed by a closed vessel which accommodates the hazardous material, that is, the nuclear fuel and which is itself contained in an outer container formed by a concrete body, see WO96/21932. The vessel forming the inner container is completely encapsulated in the concrete, the concrete providing the major part of the mechanical protection for the hazardous material and of the protection against radiation from it.

Associated with devices used for the storage of spent nuclear fuel, that is, nuclear fuel that continues to generate heat when removed from the reactor, is the problem of avoiding excessive temperatures of the device. If the vessel forming the inner container is encapsulated in the concrete, an excessive temperature may affect the concrete in course of time.

The heat generated in the inner container therefore has to be efficiently dissipated from the container and at the same time the temperature throughout the concrete body has to be kept sufficiently low so that the ageing resistance of the concrete and its ability to provide radiation protection are not seriously reduced over the time the nuclear fuel is to be stored.

An object of the invention is to provide a device of the kind indicated which offers the possibility of lastingly maintaining the concrete body at a low temperature even in the parts thereof which are closest to the vessel forming the inner container, and also a vessel suited for use as an inner container for such a device.

A device according to the invention for storing heat-generating hazardous material, particularly radioactive fuel for nuclear reactors, comprises a substantially cylindrical, reinforced concrete body with a cylindrical through centre passage and a plurality of axially elongate, substantially cylindrical storage spaces for accommodating the hazardous material which are disposed around and parallel to and radially spaced from the centre passage. The storage spaces are formed by sealed storage vessels containing a fluid coolant and made of a heat-conducting material and encapsulated in the concrete body. The storage vessels have an inner compartment for accommodating the hazardous material and an outer compartment surrounding the inner compartment and forming therewith a closed circulation path for the fluid coolant.

An inner container according to the invention, hereinafter designated the storage vessel, comprises a cylindrical outer wall and a surrounding, likewise cylindrical outer wall. The inner wall defines an inner compartment for accommodating the material to be stored (the nuclear fuel). The inner wall and the outer wall delimit an intervening outer compartment surrounding the inner compartment. The two compartments are interconnected and form a closed flow path for a fluid coolant which can circulate axially through the two compartments. When the storage vessel is encapsulated in a concrete body, the fluid coolant cools the stored material and is in its turn cooled by the outer wall which is in direct contact with the concrete body. By means of the surface of the outer wall in contact with the concrete body and the use of the circulating fluid coolant the heat is distributed over a relatively larger surface so that the thermal load on the concrete will be reduced.

The invention will be described in greater detail below with reference to the accompanying drawings which show examples of the device and the storage vessel.

Figure 1:
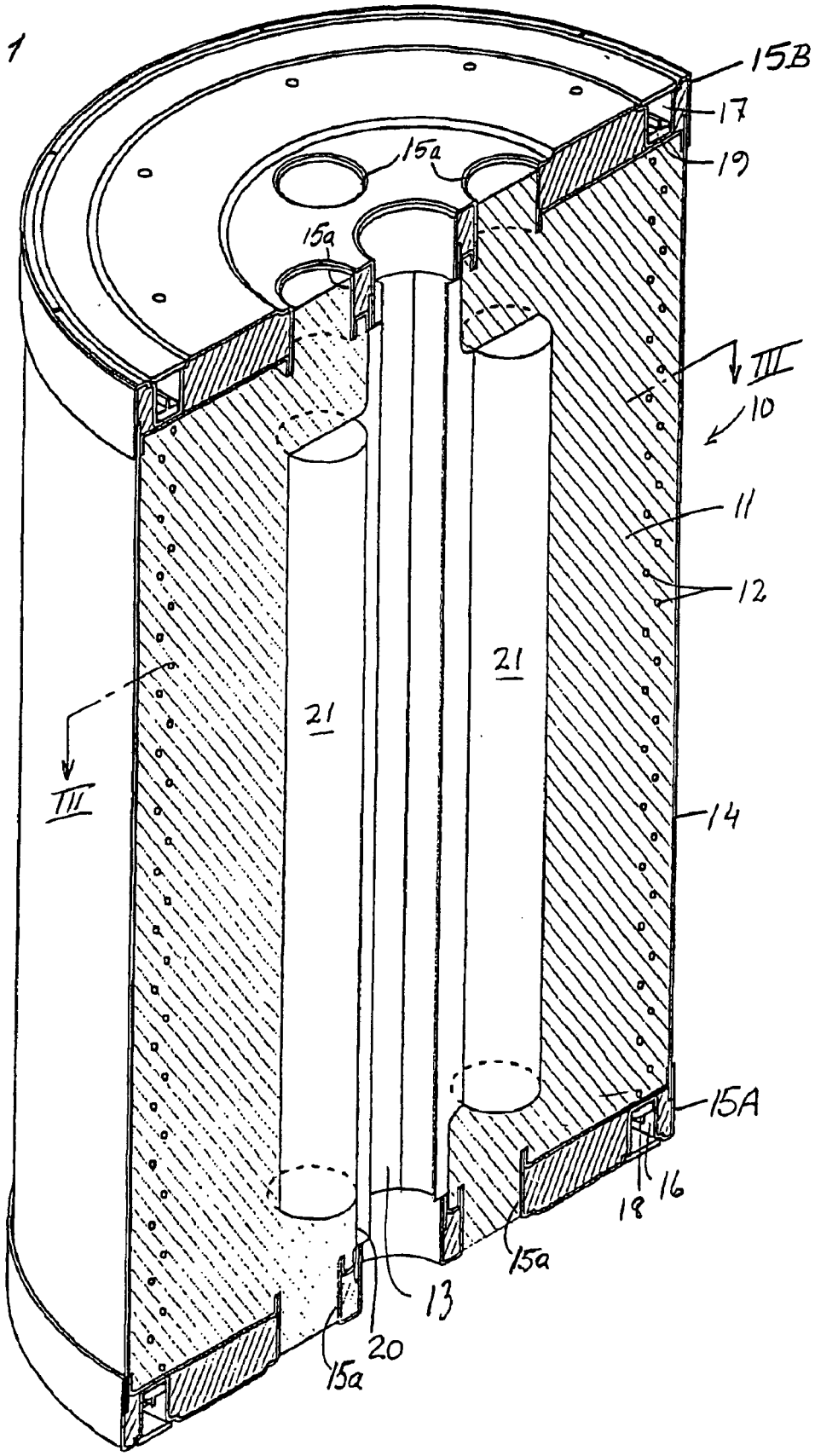
FIG. 1 is a diagrammatic sectional view of a device embodying the invention for storing nuclear fuel and comprising four storage vessels for the nuclear fuel which are encapsulated in a concrete body, the said vessels being constructed according to the invention.

Referring to FIG. 1, the storage device, which is designated by 10, is generally in the shape of an upright straight cylinder. The main part of the device 10 is a concrete body 11 that determines the basic shape of the device and is therefore also in the shape of an upright straight cylinder of circular cross-section. The concrete body 11 is three-dimensionally prestressed by means of a prestressing reinforcement 12, which is not shown in detail, and has a central axial through centre passage 13. Its circumferential surface is clad with a steel jacket 14 forming a permanent casting formwork member. A lower end cover or face plate 15A covers the lower end and an upper end cover or face plate 15B covers the upper end. Each of these elements, which likewise are permanent casting formwork members, is formed by upper and lower plates and a concrete filling cast between them. Annular channels 16 and 17 in the end covers accommodate a rail 18 and 19, respectively, in which the prestressing reinforcement 12 is anchored.

Figure 3:
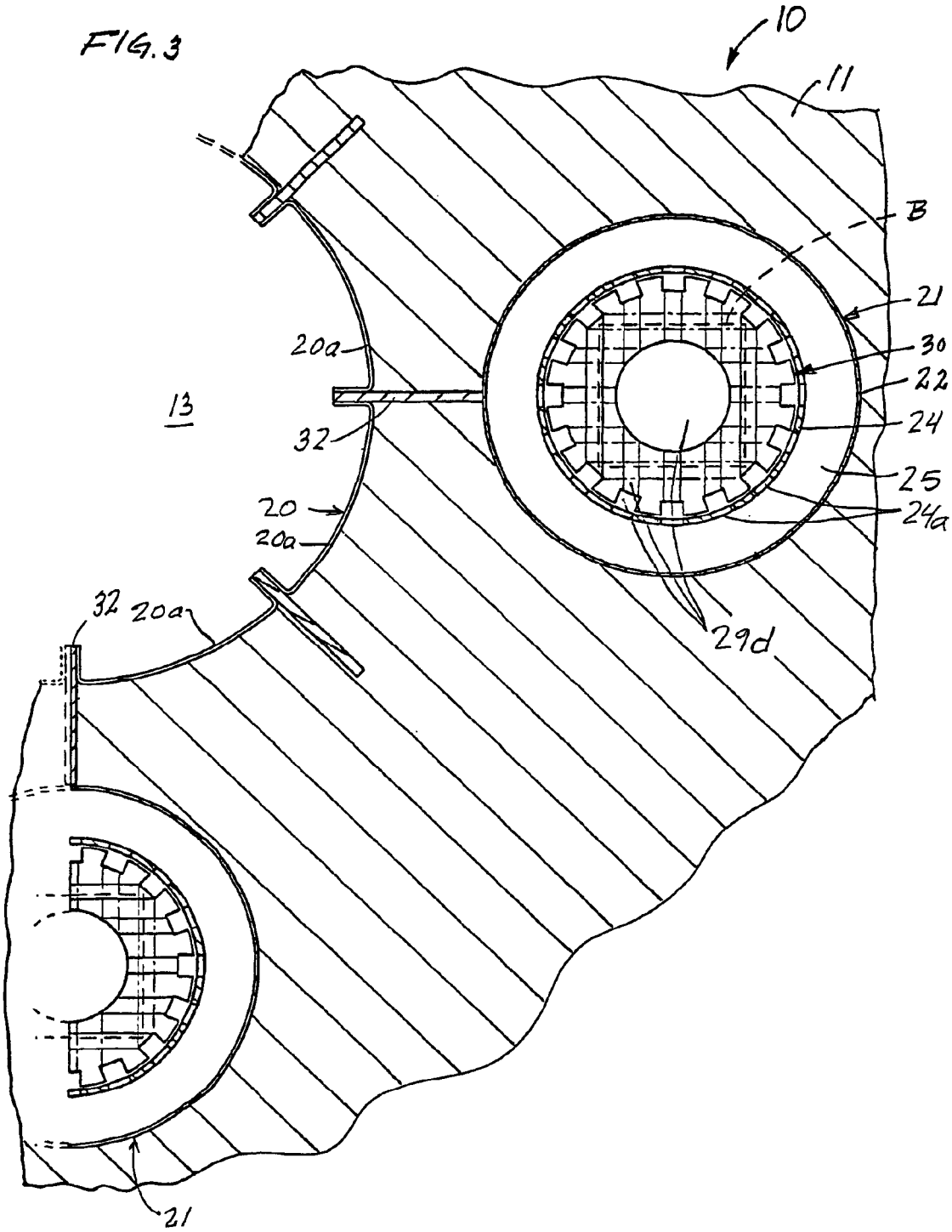
FIG. 3 is an enlarged partial horizontal sectional view on line III—III of FIG. 1.

The centre passage 13, which is extended through the lower end cover 15*a* and the upper end cover 15A, is provided with a steel lining 20 which is also a permanent casting formwork member. As is best shown in FIG. 3, the lining is made up of a plurality of arcuate sections 20*a*.

Four hermetically sealed, circular cylindrical inner containers form storage vessels for the stored hazardous material, which in this case is nuclear fuel. These storage vessels are generally designated by 21 and encapsulated in the concrete body 11 at some distance from the lining 20 but much closer to the latter than to the jacket 14. The storage vessels 21, which will be described in greater detail below, are uniformly distributed in the concrete body around the lining 20 and are equally spaced apart from the latter and from one another. They are placed in an upright position, axially aligned with concrete-filled openings 15*a* and 15*b* in the end covers 15A, 15B; these openings have been filled with concrete in connection with the casting of the concrete body 11. Should it become necessary to get access to the stored nuclear fuel in the storage vessels 21, the concrete above or below the storage vessels can be removed, e.g. by means of drilling tools, so that one end of the storage vessels becomes exposed. Then the exposed end can be opened using suitable tools so that the nuclear fuel can be extracted.

Figure 5:
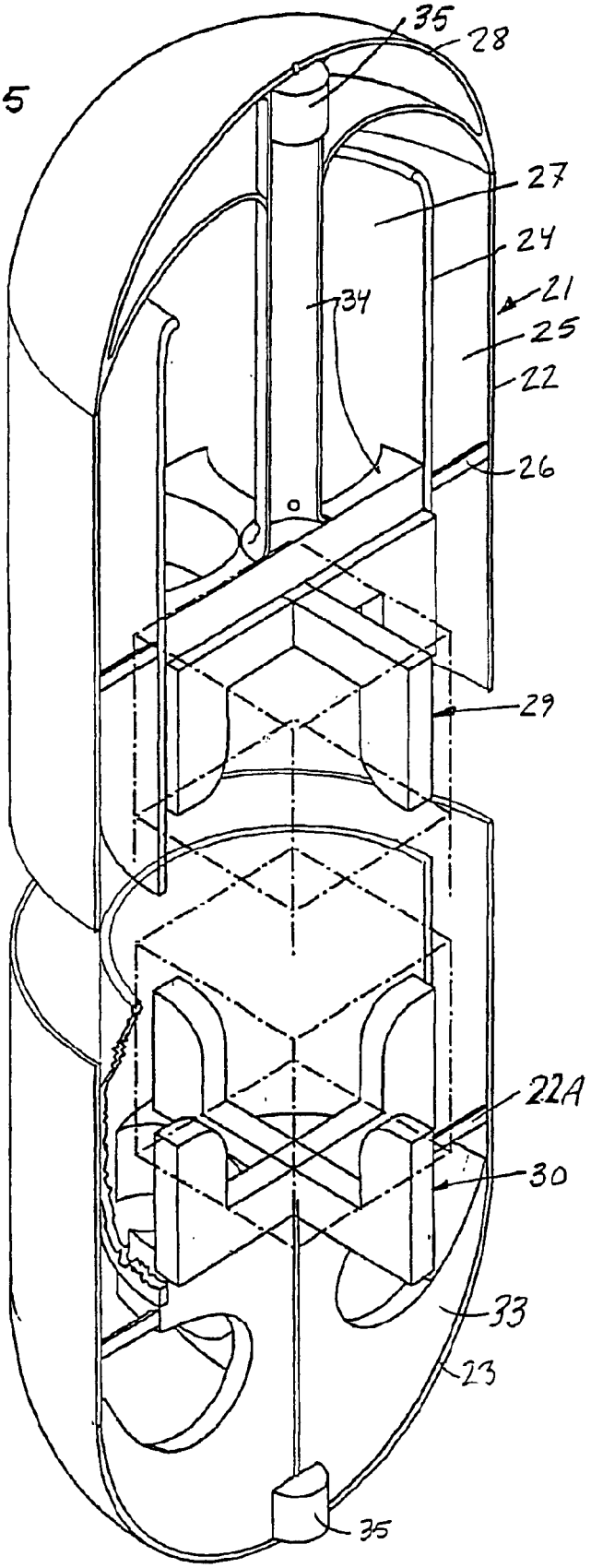
FIG. 5 is a perspective view showing a modified embodiment of the storage vessel of the storage device in FIG. 1 in axial section.

The nuclear fuel can be placed in the storage vessels 21 after these have been positioned in the formwork or, alternatively, before positioning the vessels therein (for practical reasons, this alternative is a necessity with the embodiment shown in FIG. 5). Following the pouring of the concrete, the storage vessels are completely and jointlessly encapsulated in the concrete.

Figure 2:
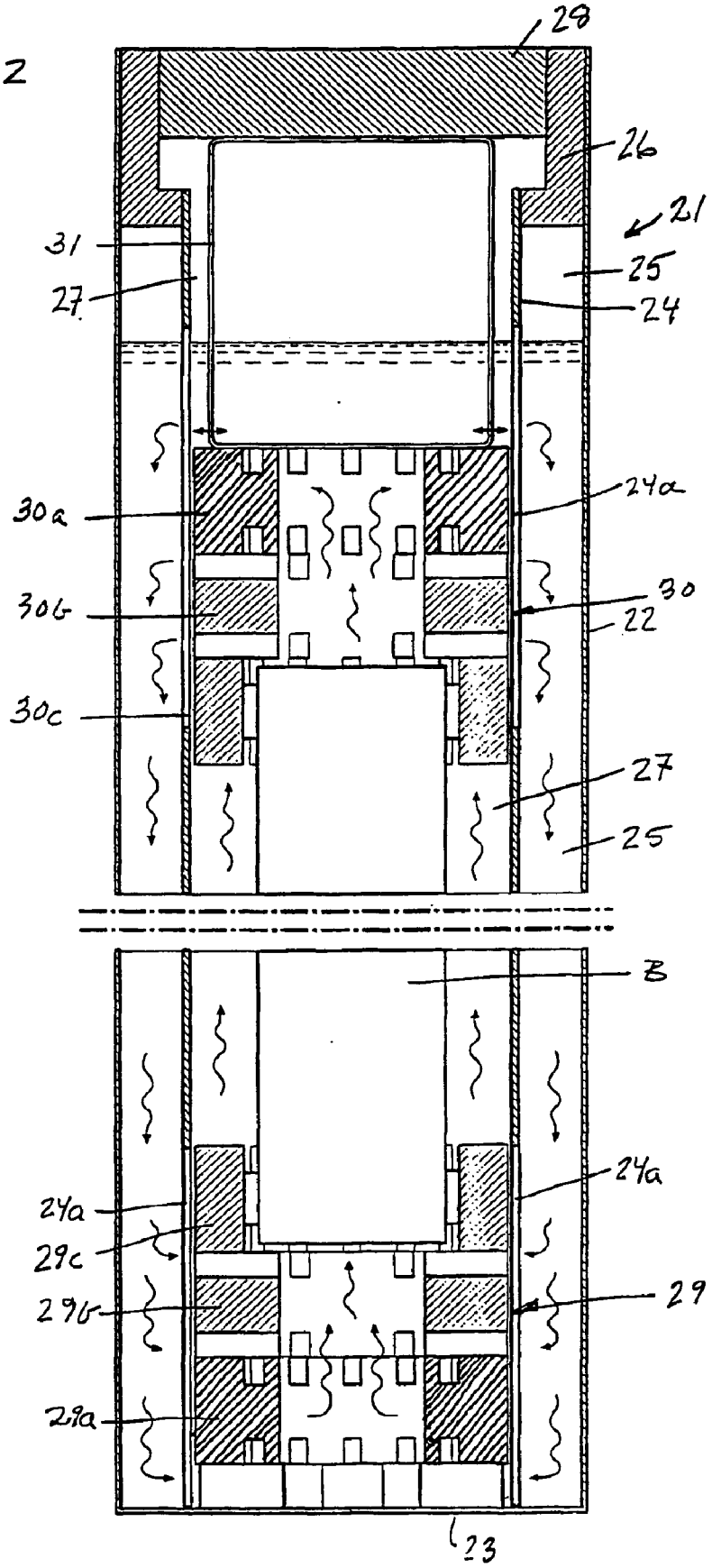
FIG. 2 is a diagrammatic axial sectional view of one of the storage vessels in FIG. 1.

FIG. 2 illustrates, partly schematically, one of the storage vessels 21 in axial section. It comprises a circular cylindrical outer wall 22 and a bottom wall 23. A likewise circular cylindrical inner wall 24 is concentric with the outer wall 22 and defines together with it an outer compartment 25 having an annular cross-section. The compartment 25 is fluid-tightly sealed upwardly by a ring 26 but at the upper and lower ends it communicates freely through vertical slots or other openings 24*a* in the inner wall 24 with an inner compartment 27 formed by the inner wall. The inner compartment is fluid-tightly sealed at its upper end, the sealing end, by means of a cover 28 which is mounted within the ring 26.

Those parts of the storage vessel 21 which are in contact with the concrete of the concrete body, that is, the outer wall 22, the bottom wall 23, and the parts at the sealing end of the storage vessel, namely the ring 26 and the cover 28, suitably are made of metal, preferably stainless steel, or other material having good corrosion resistance, strength and heat conductivity.

The storage vessel 21 contains a fluid coolant which can flow freely between the outer compartment 25 and the inner compartment 27 through the openings 24a in the inner wall 24. In FIG. 2, the fluid coolant is illustrated as being a liquid filling the storage vessel to a level close to the upper end of the vessel. The space remaining above the liquid level serves as an expansion chamber for the liquid. However, the fluid coolant may also be a gas.

The nuclear fuel stored in the storage vessel 21 may take different forms and can be, for example, a fuel element or a bundle of fuel rods. In FIG. 2 the fuel is shown as a long parallelepipedal body, fuel body, designated by B. The fuel body is centrally positioned in the inner compartment 27 and held fast therein by holder bodies 29 and 30 made of a heat insulating and resistant material, one such body at each end of the fuel body B. Each holder body 29, 30 is composed of a plurality—three in the illustrated embodiment—of holder body sections 29*a*, 29*b*, 29*c* and 30*a*, 30*b*, 30*c*, of a material that is stable in shape and resistant to ageing, preferably foam glass. Foam glass is characterised by, among other things, good thermal insulation, and is very resistant, even at high temperatures.

The lower holder body 29 rests on the bottom wall 23. The upper holder body 30 is supported against the cover 28 through a hollow filler body 31, the cavity of which communicates with the outer compartment 25 and the inner compartment 27. The free spaces in the compartments 25 and 27 and the filler body 31 form an expansion chamber. The holder bodies 29, 30 are shaped such that they surround the respective adjacent ends of the fuel body B so that they support and locate it laterally and at the same time support and locate it axially.

Both holder bodies 29, 30 have a wide, centrally located, axially extending through passage and a large number of smaller, axial and transverse passages. The system of passages in the holder bodies is structured such that the fluid coolant can flow almost without impediment along the outer surfaces of the fuel body B even where the support bodies are located.

When the fuel body B is in position in the storage vessel 21, the fluid coolant will circulate in the storage vessel by natural convection caused by the heat produced in the fuel body B, the fluid coolant flowing upwardly in the inner compartment 27 along the sides of the fuel body and, where the structure of the fuel body permits, also within the fuel body, and is then deflected 180° at the upper end of the storage vessel 21 and flows downwardly in the outer compartment 25. At the upper holder body 30 the fluid coolant flows substantially unimpeded through the central axial passage of the holder body and its transverse passages and then from the inner compartment 27 to the outer compartment 25 via the openings 24*a* in the upper part of the inner wall 24. At the lower holder body 29, the fluid coolant flows in a corresponding manner from the outer compartment 25 into the inner compartment 27 via the openings 24*a* in the lower part of the inner wall 24 and through the transverse passages and the central axial passage of the holder body. Because of the heat insulating properties of the holder bodies 29, 30 the holder bodies do not form any undesired heat-conducting bridge that transfers heat direct to the inner wall 24.

Because of its circulation, the fluid coolant transfers heat to the outer compartment 25 where the heat is transferred to the concrete body as a consequence of the contact with the outer wall 22. The major part of the heat passes through the lining 20 into the air in the centre passage 13 of the concrete body 11 and via the air away from the storage device 10. The remaining, smaller part passes outwardly to the jacket 14 of the storage device and via the jacket to the ambient air.

FIG. 3 illustrates in greater detail the structure of the interior of the storage device 10, namely the part where the storage vessels 21 are disposed in the concrete body 11. As shown in that figure, between each pair of adjacent storage vessels 21 there is space for a further storage vessel so that the storage device would be capable of accommodating eight circumferentially uniformly distributed storage vessels 21 instead of four as in the illustrated embodiment. The illustrated embodiment with only four storage vessels 21 was chosen in order that the concrete temperature might be kept low, e.g. 100° C. or even lower, around the storage vessels, even with strong heat generation by the nuclear fuel elements.

Between each storage vessel 21 and the steel sheet lining 20 covering the wall of the centre passage 13 in the concrete body 11 a metal bar 32 is positioned which is connected in heat-transfer relation to the outer wall 22 of the storage vessel and the lining 20. This bar 32, which extends throughout or nearly throughout the height of the storage device 10 or at least nearly throughout the height of the storage vessel 21, forms a member having high heat conductivity for transferring heat from the storage vessel and the concrete adjacent to the storage vessel to the air in the centre passage 13. Although the figure shows only one such heat-transfer member, it will be appreciated that additional similar members may be provided to improve the heat transfer.

FIG. 3 also shows part of the system of axial and transverse passages in the holder body 29 which present to the fluid coolant in the storage vessel a virtually unimpeded flow path past the upper end portion of the fuel body B. These axial and transverse passages are collectively designated by the reference character 29d and may be regarded as representative of the corresponding system of fluid coolant passages in the lower holder body 30 as well.

In the interest of clarity of the illustration of the invention, the representation of the storage device 10 and the storage vessels 21 in FIGS. 1 to 4 is greatly simplified. It is quite easy for the skilled person to accomplish the structural design of the storage device and the storage vessel which is required to reduce the invention to practice, taking into consideration the kind of nuclear fuel or other hazardous material to be stored and the purpose of the storage.

FIG. 5 shows another exemplary embodiment of the part of the invention which relates to the storage vessels 21. Elements in FIG. 5 which are identical with or at least functionally correspond to elements in the embodiment of FIGS. 1 to 4 have the same reference characters as in that embodiment.

The storage vessel in FIG. 5 is also substantially circular cylindrical, but its ends, the lower or bottom end and the upper or sealing end, are dome-shaped in this case.

Figure 4:
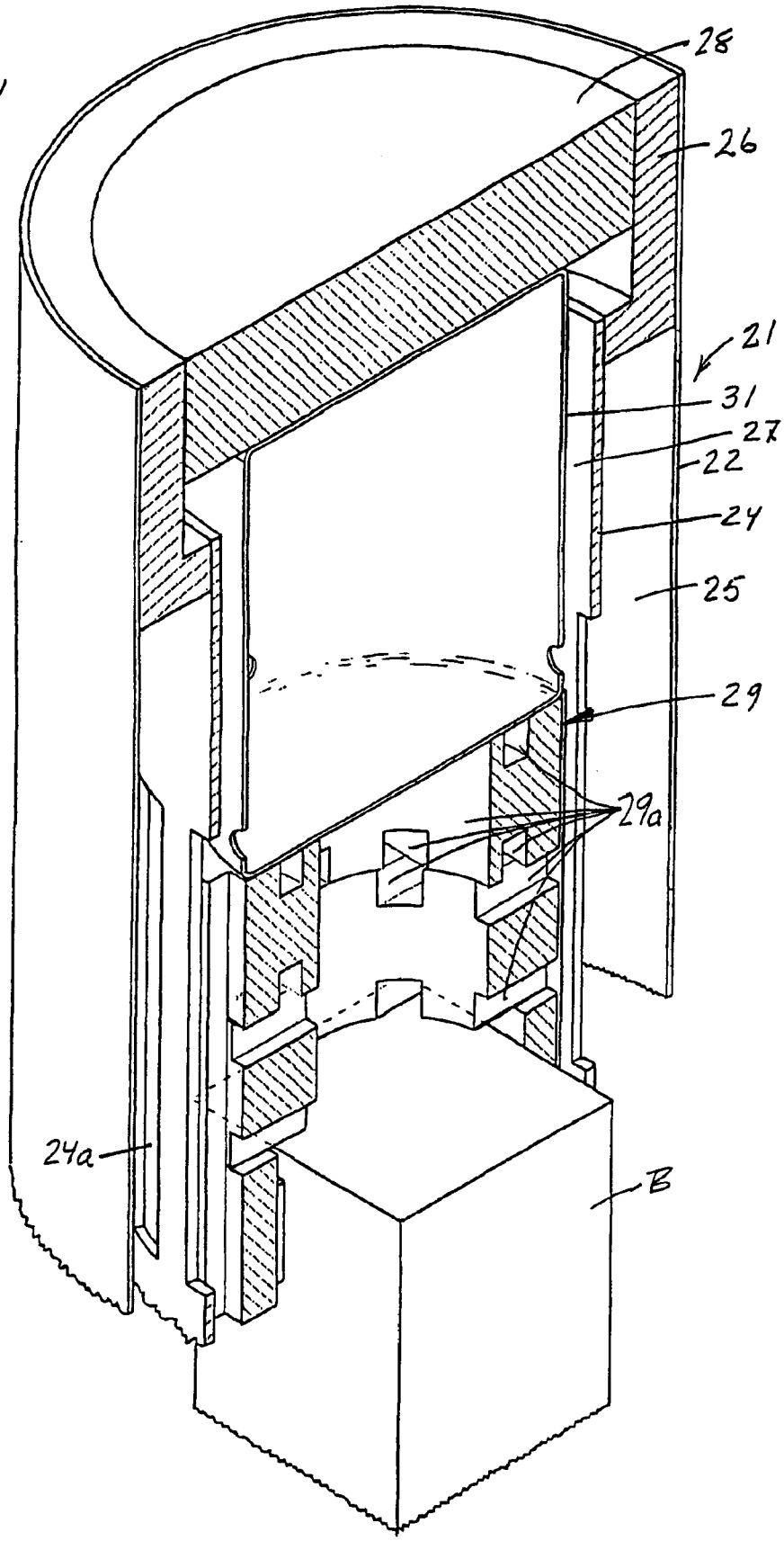
FIG. 4 is an enlarged axial perspective view in axial section of the upper part of the storage vessel in FIG. 2.

In this embodiment, the outer compartment 25 communicates with the inner compartment 27 across the upper and lower edges of the inner wall 24 which for that reason does not have openings corresponding to the openings 24*a* in FIGS. 2 to 4. To keep the inner wall 24 in position relative to the outer wall 22, transverse supports 22A and a support body 33, of generally cruciform shape in plan view and made of concrete, for example, are provided at the bottom end of the storage vessel. The support body 33 has a round base, the bottom side of which is of a shape corresponding to the shape of the inner side of the lower end of the storage vessel, that is, the shape of the bottom wall 23, and is weighted such that it contributes to keeping the storage vessel upright when it is immersed in water.

In this embodiment as well, the holder bodies 29, 30 are made of a heat-insulating material of long-term stability even at elevated temperatures, such as foam glass, but are of cruciform shape with upstanding support lugs at the free ends of the arms. The upper holder body 29 is supported from above by another cruciform support body 34 having a tubular shank secured to the dome-shaped cover 28. The lower holder body 30 rests on the support body 33.

The fluid coolant in this case is a gas, such as nitrogen, but circulates in substantially the same manner in a closed circulation circuit formed by the outer compartment 25, the inner compartment 27, the bottom wall 23 and the cover 28. The cruciform shape of the holder bodies 29, 30 and the support bodies 33 and 34 provides ample space for the flow of the fluid coolant between the compartments 25 and 27.

In the cover 28 and the support bodies 33, 34 valves 35 are provided through which the storage vessel can be filled with the fluid coolant.

In this embodiment the storage vessel 21 is sealed by welding the cover 28 to the outer wall 22. Introduction of the fuel body B and welding of the cover suitably are carried out on a site separated from the site where the concrete body 11 is cast. Following its sealing, the loaded storage vessel 21 is transferred to the casting site where it is placed in the permanent casting formwork comprising the jacket 14, the end covers 15A, 15B and the lining 20 (see FIG. 1). Suitably, the formwork is submerged, the storage vessel 21 suitably being kept in a submerged position throughout its transfer. When the sealed storage vessel 21 is introduced in the casting formwork, it may be lowered through the openings in the upper end cover 15B to a support structure which is mounted in the formwork and guides the storage vessel to the proper position during the lowering and secures it relative to the formwork. Then the casting of the concrete body 11 can be effected. Naturally, the same procedure can be used in the case where the storage vessel is sealed by attaching the cover by means of screws as with the storage vessel in FIGS. 1 to 4. In the embodiment of FIG. 5, it is also possible first to mount the unloaded storage vessel in the casting formwork and then insert the fuel body B and complete the sealing.

In the embodiment of FIG. 5, the cover 28 is double-walled (the cavity may be filled with an insulating material) and shaped such that the underside forms a smooth transition in the flow path between the upper end of the inner compartment 27 and the upper end of the outer compartment 25. The double wall of the cover protects the concrete in the concrete body 11 against excessive heating at the upper part of the storage vessel 21 where the temperature of the circulating fluid coolant is at its maximum.

Regardless of the design of the storage vessel 21, its innermost part, the part closest to the lining, should be sufficiently spaced from the lining to ensure both a problem-free pouring of the concrete around the storage vessel and an adequate mechanical protection of the storage vessel. Having regard to these requirements, the spacing may be 10 to 15 cm or possibly, especially if the lining 20 is thick, slightly less. Such small spacing may not be adequate to make the radiation in the passage 13 without risk or harmless to humans, but since humans are not supposed to be in that passage, this is not a major problem. Having regard to the cooling, the spacing should be as small as possible in order that the heat transfer from the storage vessel 21 to the passage 13 may be as efficient as possible, but in view of the above-mentioned requirements with respect to problem-free encapsulation and mechanical protection, a lower limit must be observed. The minimum spacing should therefore preferably be from about 10 cm to about 15 cm.

The requirement for efficient dissipation of heat from the passage also calls for a certain minimum diameter of the passage. If the storage device 10 is kept in air and loaded with four storage vessels 21, each having a heat generation of 1200 W, for example, a diameter of 600 to 700 mm or slightly more is suitable with natural convection in the passage 13. Adequate cooling can be had even with a diameter less than 600 mm if the air flow in the passage 13 is forced or if the storage device 10 is submerged in water.

The concrete between the outermost part of the storage vessels 21 and the jacket 14 should be adequate for the temperature at the outer surface of the storage device 10 not to exceed a limit of, for example 100° C. If that limit applies, 60 cm may be a preferred minimum distance between the outermost part of the storage vessels 21 and the jacket 14 if the concrete body consists of ordinary concrete. If a higher degree of safety is required or desired, 70 cm may be a preferred minimum distance. Some reduction of the stated minimum values may be possible, e.g. if so-called iron-ore concrete is used.

What is claimed is:

1. A device for storing heat-generating hazardous material, including radioactive fuel for nuclear reactors, comprising a substantially cylindrical, reinforced concrete body with a cylindrical through centre passage and a plurality of axially elongate, substantially cylindrical storage spaces accommodating the hazardous material which are disposed around and parallel to and radially spaced from the centre passage and which are formed by sealed storage vessels containing a fluid coolant and made of a heat-conducting material and encapsulated in the concrete body, the storage vessels having an inner compartment for accommodating the hazardous material and an outer compartment surrounding the inner compartment and forming therewith a closed circulation path for the fluid coolant.

2. A device according to claim 1, characterised in that the distance from the storage vessels to the wall of the centre passage is substantially smaller than their distance from the circumferential surface of the concrete body.

3. A device according to claim 1, characterised in that the storage vessels are substantially uniformly distributed about the centre passage with their axes positioned on an imaginary cylinder which is concentric with the centre passage.

4. A device according to claim 1, characterised in that the shortest distance between the storage vessels and the wall of the centre passage is at least 10 cm and not more than 15 cm, the shortest distance between the storage vessels and the circumferential surface of the concrete body is at least about 600 mm, and the cross-sectional area of the centre passage is at least equal to the area of a circle the radius of which is 300 mm.

5. A device according to claim 1, characterised in that the storage vessels are jointlessly encapsulated in the concrete of the concrete body.

6. A device according to claim 1, characterised in that elements of high thermal conductivity are disposed in the concrete body between the storage vessels and the centre passage.

7. A device according to claim 1, characterised in that the concrete body is provided on the outer surface thereof with a metal jacket and the centre passage is provided with a metal lining.

8. A device according to claim 7, characterised in that the elements of high thermal conductivity contact both the storage vessels and the lining of the centre passage.

9. A device according to claim 1, characterised in that the ends of the concrete body are provided with end members having an opening which forms an extension of the centre passage, and in that at least the end member at one end of the concrete body has openings for passing the storage vessels therethrough.

10. A device according to claim 1, characterised in that each storage vessel has a cylindrical outer wall, a bottom wall at one of the ends of the outer wall, designated as the bottom end, and a device for fluid-tight sealing of the vessel at the opposite end, designated as the sealing end, a cylindrical inner wall delimiting an inner compartment for accommodating stored material, and a surrounding outer compartment, and a fluid-conducting connection between the inner compartment and the outer compartment both in the region of the bottom end of the outer wall and in the region of the sealing end of the outer wall to allow for circulation of a fluid coolant in the axial direction through the inner and outer compartments.

11. A device according to claim 10, characterised in that the storage vessel comprises a pair of holder bodies, one in the region of the bottom end of the outer wall and one at the sealing end of the outer wall, for axially positioning and centring the fuel body in the inner compartment with a spacing between it and the inner wall.

12. A device according to claim 11, characterised in that the holder bodies are made of a material of poor thermal conductivity.

* * * * *